US006826937B2

(12) United States Patent
Su

(10) Patent No.: US 6,826,937 B2
(45) Date of Patent: Dec. 7, 2004

(54) LOCK WITH LOCKING ELEMENTS RESPECTIVELY FITTED TO INNER AND OUTER SIDES OF A DOOR

(76) Inventor: Chin-Yun Su, No. 45, Yuhsin 1st Street, Tainan (TW)

( * ) Notice: Subject to any disclaimer, the term of this patent is extended or adjusted under 35 U.S.C. 154(b) by 0 days.

(21) Appl. No.: 10/609,474

(22) Filed: Jul. 1, 2003

(65) Prior Publication Data

US 2004/0040356 A1 Mar. 4, 2004

(30) Foreign Application Priority Data

Aug. 29, 2002 (TW) ..... 91213529 U

(51) Int. Cl.[7] ..... E05B 9/08

(52) U.S. Cl. ..... 70/370; 70/107; 70/208; 70/417; 70/451

(58) Field of Search ..... 70/107, 208, 370–372, 70/450, 451, 448, 466, 416, 417

(56) References Cited

U.S. PATENT DOCUMENTS

| | | | | | |
|---|---|---|---|---|---|
| 2,919,571 | A | * | 1/1960 | Welch | 70/451 |
| 3,455,129 | A | * | 7/1969 | Forbes et al. | 70/370 |
| 3,740,979 | A | * | 6/1973 | Crepinsek | 70/139 |
| 4,073,172 | A | * | 2/1978 | Schlage | 70/417 |
| 4,296,619 | A | * | 10/1981 | Widen | 70/451 |
| 4,530,223 | A | * | 7/1985 | Oliver | 70/417 |
| 4,576,023 | A | * | 3/1986 | Crepinsek | 70/137 |
| 4,813,250 | A | * | 3/1989 | Yeh | 70/104 |
| 4,887,856 | A | * | 12/1989 | Percoco et al. | 292/337 |
| 5,267,461 | A | * | 12/1993 | Eizen | 70/451 |
| 5,419,167 | A | * | 5/1995 | Yamada et al. | 70/208 |
| 5,586,796 | A | * | 12/1996 | Fraser | 292/346 |
| 5,761,936 | A | * | 6/1998 | Katayama | 70/224 |
| 5,787,741 | A | * | 8/1998 | Shen | 70/107 |
| 5,881,585 | A | * | 3/1999 | Kang | 70/107 |
| 5,950,467 | A | * | 9/1999 | Dong | 70/467 |
| 6,058,746 | A | * | 5/2000 | Mirshafiee et al. | 70/107 |
| 6,490,894 | B1 | * | 12/2002 | Laurent | 70/208 |
| 6,497,126 | B2 | * | 12/2002 | Wang | 70/472 |
| 6,698,260 | B2 | * | 3/2004 | Su | 70/134 |
| 6,701,758 | B2 | * | 3/2004 | Hoffmann | 70/208 |
| 2002/0134123 | A1 | * | 9/2002 | Huang | 70/450 |
| 2003/0192355 | A1 | * | 10/2003 | Char et al. | 70/107 |

* cited by examiner

*Primary Examiner*—Suzanne Dino Barrett
(74) *Attorney, Agent, or Firm*—Rosenberg, Klein & Lee

(57) ABSTRACT

A bi-directional lock is used on a door of a house; which is comprised of inner and outer locking elements respectively fitted to inner and outer sides of the door so that people inside the house also have to use the key to unlock the door after the door has been locked; the lock is secured to the door in such a manner that none of the screws show that are used to fasten the lock to the door, preventing thieves from easily damaging, dismantling or removing the lock from the door to open the door.

2 Claims, 6 Drawing Sheets

LOCK WITH LOCKING ELEMENTS RESPECTIVELY FITTED TO INNER AND OUTER SIDES OF A DOOR

BACKGROUND OF THE INVENTION

1. Field of the Invention

The present invention relates to a lock, which is comprised of inner and outer locking elements respectively fitted to inner and outer sides of a door so that people inside the room also have to use the key to unlock the door after the door is locked, more particularly one, which is secured to the door in such a manner that none of the screws show that are used to fasten the lock to the door, preventing thieves from easily damaging, dismantling or removing the lock to open the door.

2. Brief Description of the Prior Art

Conventional door locks are comprised of a locking element on an outer side of the door, and a knob on an inner side of the door so that after the door is locked, people outside the house cannot open the door without the key while people inside the house can open the door without the key. Such locks are not ideal because thieves can open the door to easily steal after they have entered the house from windows stealthily. Therefore, bi-directional locks are provided to overcome the above disadvantages, which locks are made such that people inside the room also have to use the key to open the door after the door is locked.

Referring to FIG. 6, a conventional bi-directional lock is provided, which is comprised of inner and outer locking elements 10, 20 secured to inner and outer sides of a door 30 so that people inside the house also has have to use the key to unlock the door 30 after the door 30 is locked with the lock; screws 40 are screwed through the inner locking element 10, and the door 30, and then screwed into the outer locking element 20. Thus, a person in the house without the key can't operate the inner locking elements 10 to unlock the door in case the door has been locked by means of operating the outer locking element 20 with the key.

The above lock is easy to damage or dismantle because the screws 40 show on the inner side of the door, and can be easily screwed off the lock. Therefore, thieves can easily unlock, and open the door 30 after they have entered the room stealthily. Consequently, thieves can leave the house through the door, making it difficult for other people to suspect that thieves are stealing, and can easily steal large properties from the house by moving them via the door.

SUMMARY OF THE INVENTION

It is a main object of the present invention to provide a bi-directional lock to a house so that people inside the house also have to use the key to unlock the door after the door is locked, and which lock is secured to the door in such a manner that none of the fixing elements show that are used to fasten the lock to the door, preventing thieves from easily removing the lock from the door to open the door.

The lock is comprised of inner and outer locking elements respectively disposed on inner and outer sides of a door; the outer locking element has several hollow posts, which project into the door and don't communicate with outside, and into which screws are screwed from the inner side of the door; the inner locking element has several fixing posts, which project into the door, and into which screws are screwed from the free end of the door where the dead bolt is disposed.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
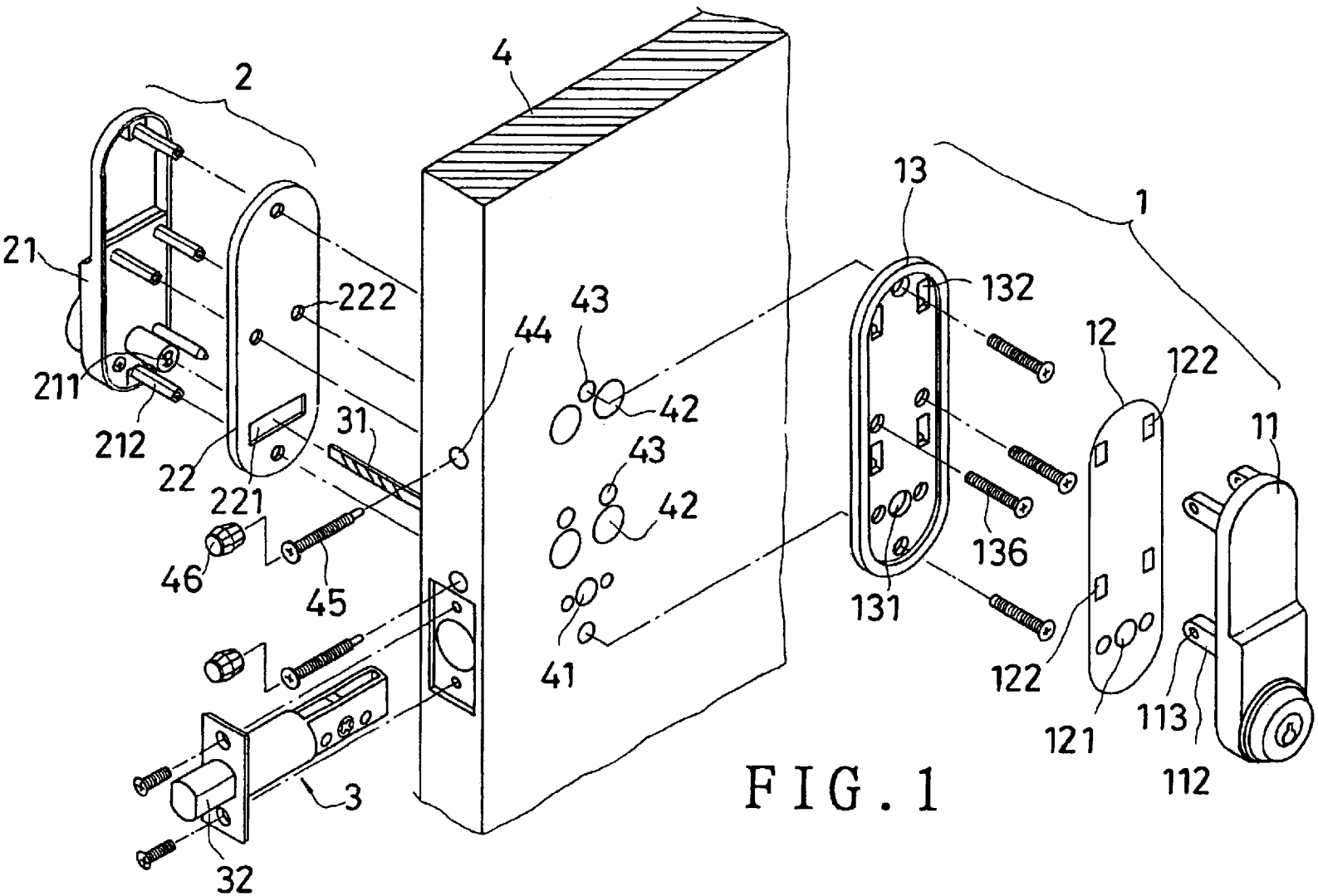
FIG. 1 is an exploded perspective view of the bi-directional lock according to the present invention.
Figure 2:
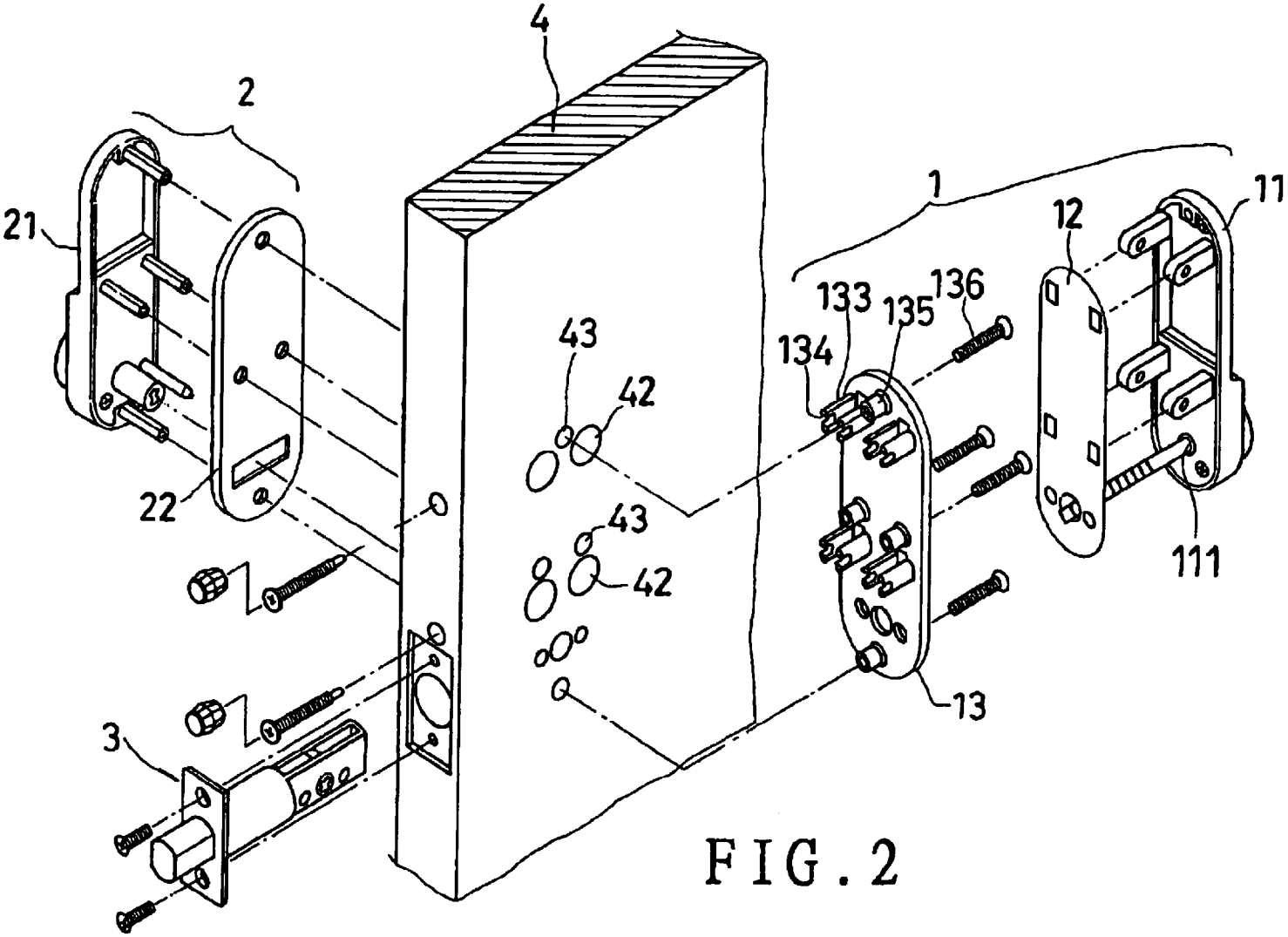
FIG. 2 is another exploded perspective view of the bi-directional lock according to the present invention.

Referring to FIGS. 1, and 2, a preferred embodiment of a bi-directional lock in the present invention includes an engaging element 3, an inner locking element 1, and an outer locking element 2 respectively secured to inner and outer sides of a door 4 near to a first edge of the door 4.

The inner locking element 1 consists of a lock base 11, a pad 12 disposed over a first side of the lock base 11, and a fixing base 13 disposed over a first side of the pad 12. The lock base 11 has a co-moving hole 111 for insertion of a key of the lock therein, several fixing posts 112, which project from the first side of the lock base 11, and each of which has a horizontally extending screw hole 113 at a tail end thereof. The pad 12 has a first through hole 121 positioned around the co-moving hole 111 of the lock base 11, second through holes 122 positioned around corresponding fixing posts 112 of the lock base 11. The fixing base 13 has a first through hole 131 facing the hole 121 of the pad 12, second through holes 132 also positioned around corresponding fixing posts 112 of the lock base 11, several locating posts 133 projecting from a first side thereof, third through holes (not numbered), and hollow connecting posts 135, which project from the first side of the fixing base 13, and which are aligned with respective third through holes of the fixing base 13. Each hollow connecting post 135 is formed with screw threads on an inner side thereof. Each locating post 133 is formed with a laid-down U-shaped locating gap 134 at a tail end thereof.

The outer locking element 2 consists of a lock base 21, and a pad 22 disposed over a first side of the lock base 21. The lock base 21 has a co-moving hole 211, and several hollow posts 212, which project from the first side of the lock base 21, and each of which has screw threads on an inner side thereof. The pad 22 has a through hole 221 positioned around the co-moving hole 211 of the lock base 21, and connecting holes 222 positioned around respective hollow posts 212 of the lock base 21.

The engaging element 3 is secured to the first edge of the door 4, and has a co-moving rod 31 connected to the co-moving holes 111, 211 of the locking elements 1, and 2 so that the co-moving rod 31 can be moved when the key of the lock is operated in one of the holes 111, 211. The engaging element 3 has a dead bolt 32, which is connected to the co-moving rod 31 such that it can be moved between a projecting locking position and a retreating unlocking position by means of operating the locking elements 1, 2 with the key.

The door 4 has a first through hole 41, several second through holes 42, several connecting holes 43, and third through holes 44 extending horizontally from the first edge thereof to communicate with corresponding second through holes 42.

Figure 3:
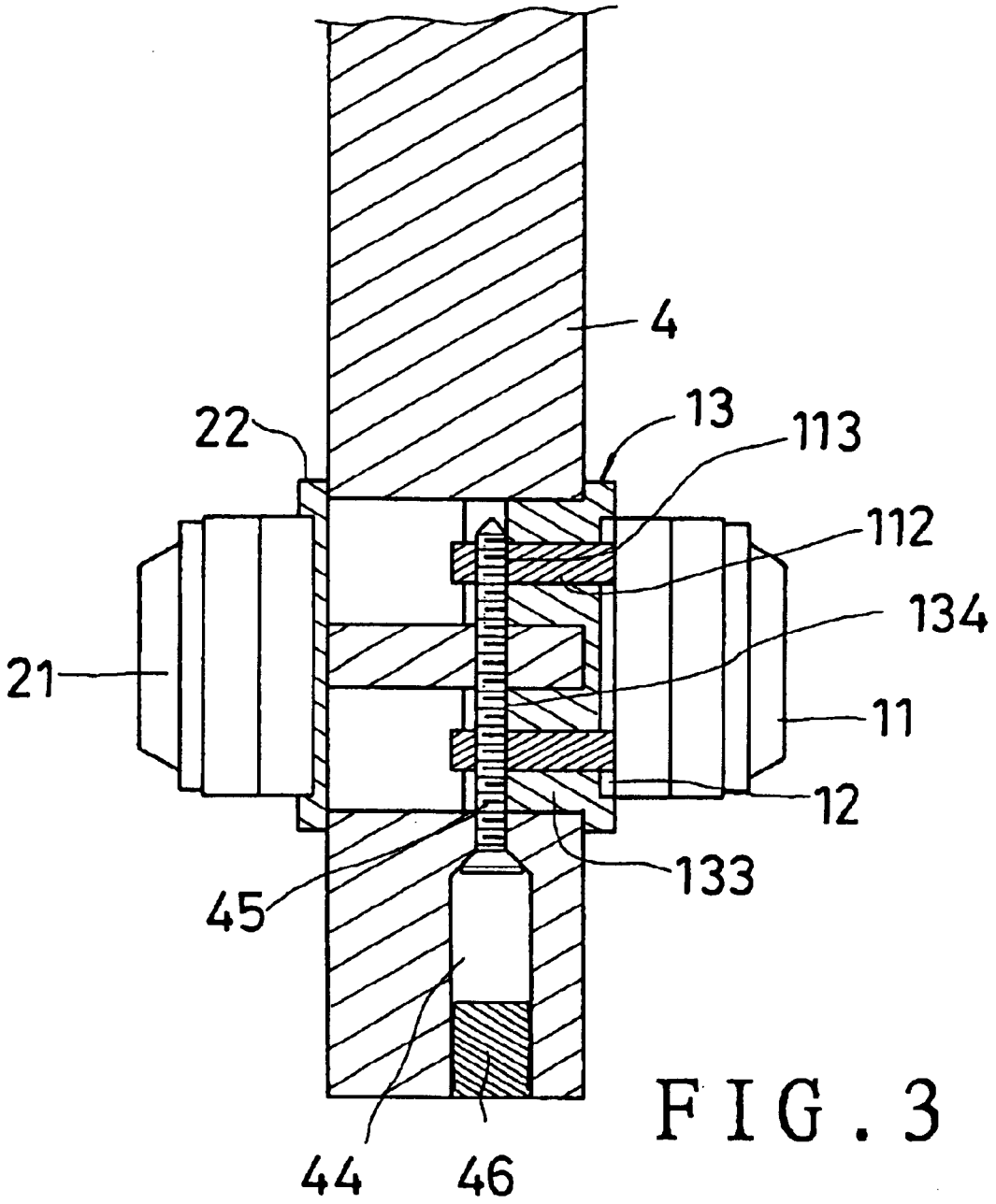
FIG. 3 is a horizontal section of the bi-directional lock according to the present invention.
Figure 4:
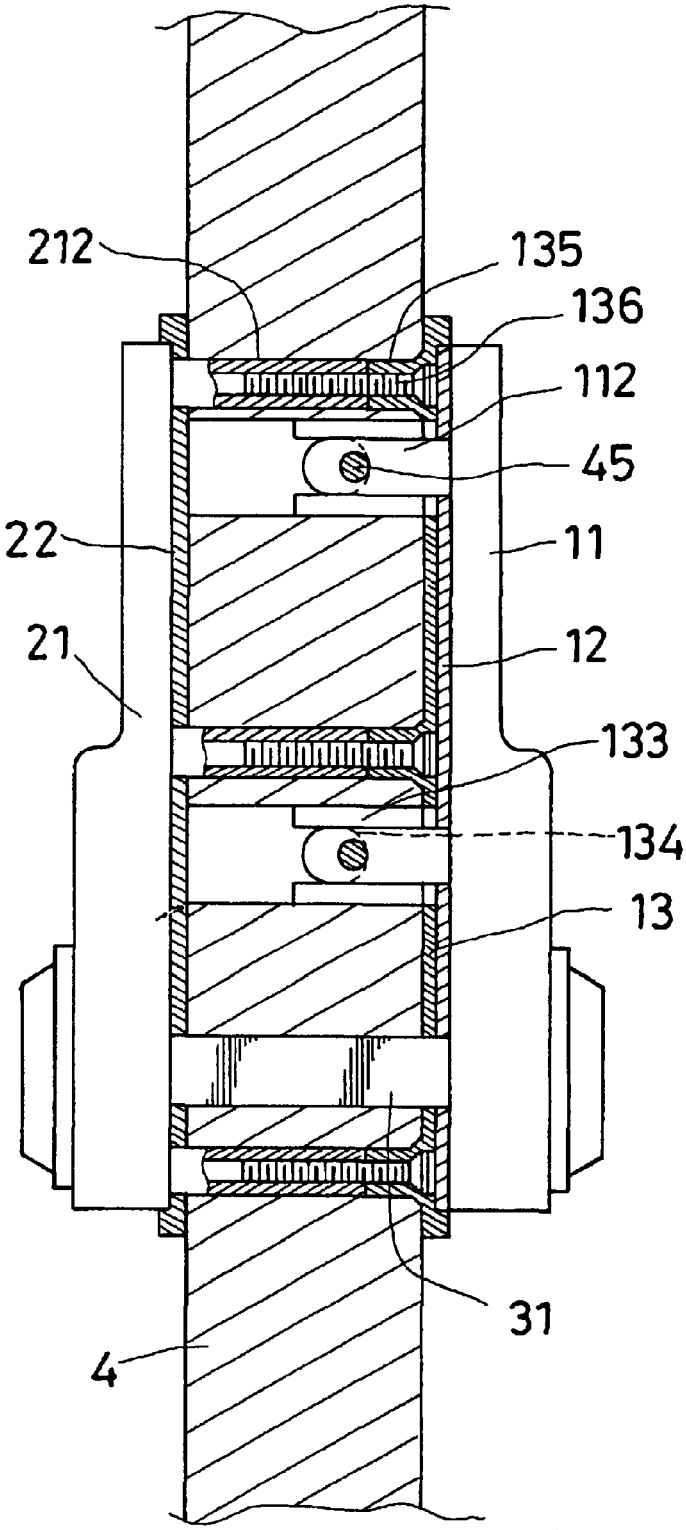
FIG. 4 is a vertical section of the bi-directional lock according to the present invention.
Figure 5:
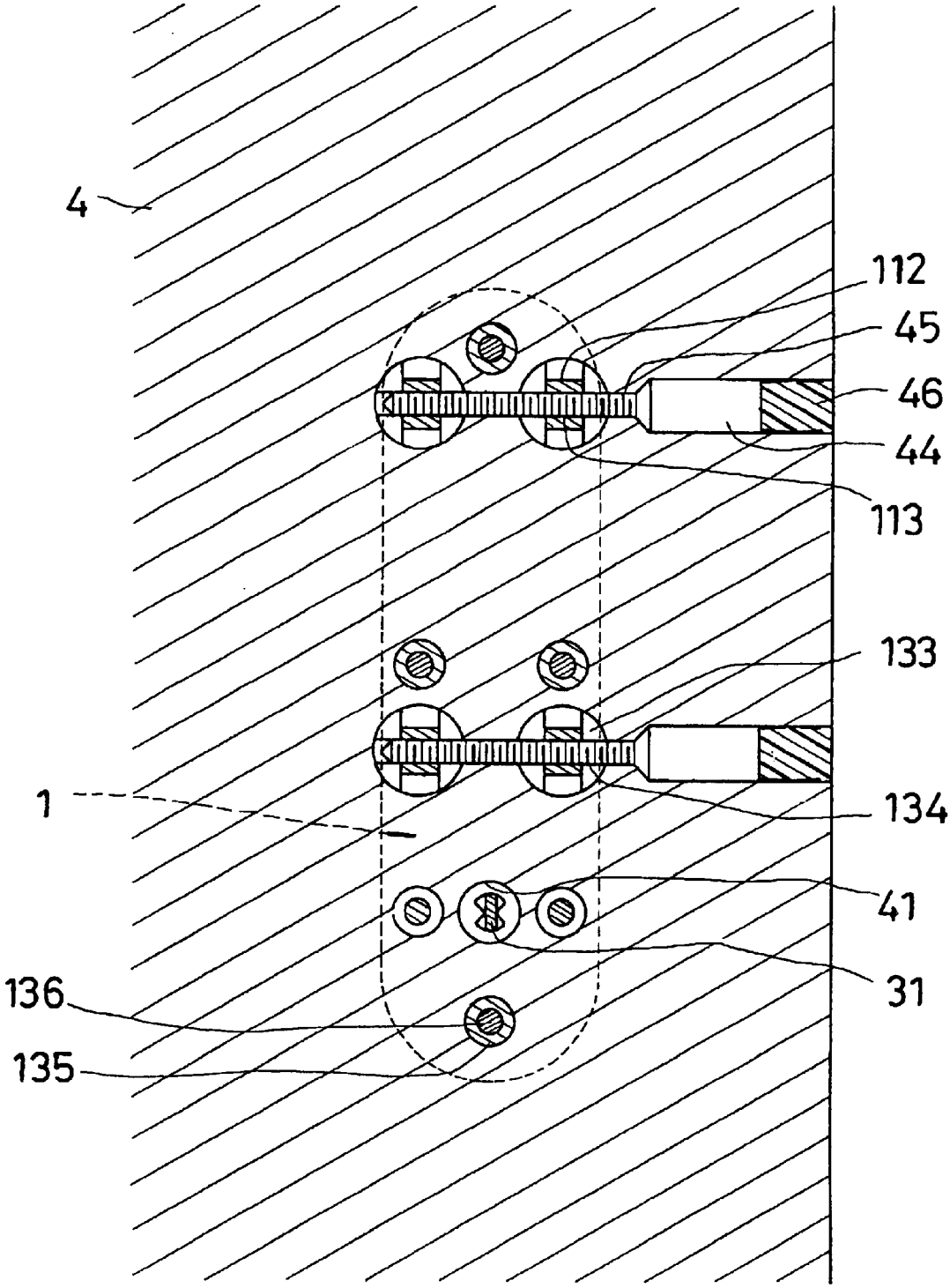
FIG. 5 is another vertical section of the bi-directional lock according to the present invention.
Figure 6:
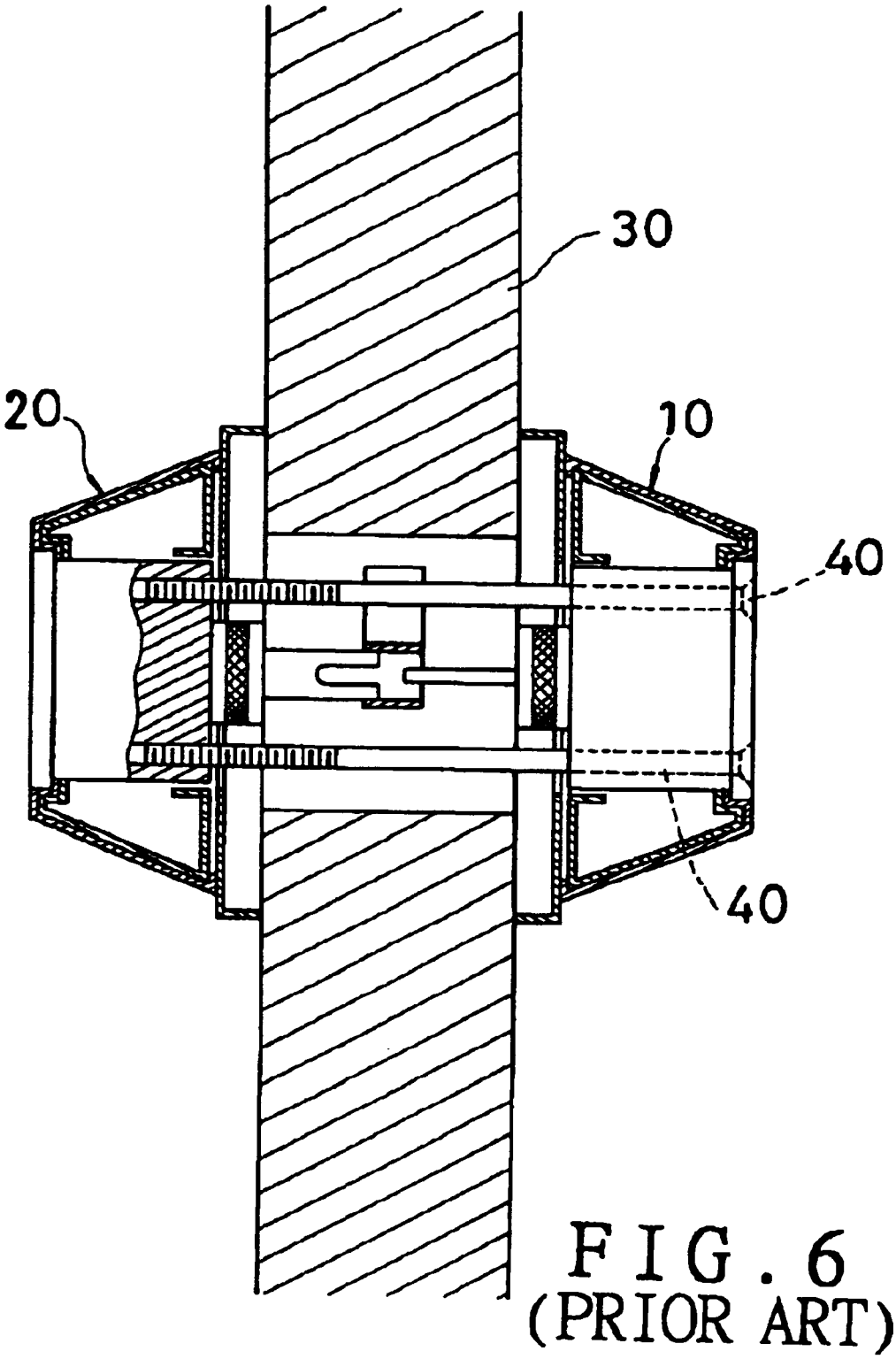
FIG. 6 (PRIOR ART)
FIG. 6 is a vertical section of the conventional bi-directional lock as described in the Background.

To install the present lock to the door 4, referring to FIGS. 3 to 5, firstly, the engaging element 3 is secured to the first edge of the door 4 with the co-moving rod 31 being inserted in the first hole 41 of the door 4. Secondly, after having been joined to the pad 22 in the way mentioned above, the lock base 21 of the outer locking element 2 is joined to the outer side of the door 4 with the co-moving hole 211, and the hollow posts 212 being respectively fitted into the first hole 41, and the connecting holes 43 of the door 4; the co-moving hole 211 is joined to one end of the co-moving rod 31. Thirdly, the fixing base 13 is joined to the outer side of the door 4 with screws 136 being screwed into the threaded hollow connecting posts 135, the connecting holes 43 of the door 4, and the threaded hollow posts 212 of the outer locking element 2 so that the outer locking element 2 is securely joined to the door 4; the hole 131 is faced with the first hole 41 of the door 4. And, after having been joined to the pad 12 in the way mentioned above, the lock base 11 of the inner locking element 1 is joined to the door 4 with the fixing posts 112 being inserted in respective second through holes 42 of the door 4, and with the co-moving hole 111 being connected to other end of the co-moving rod 31 of the engaging element 3. Then, referring to FIGS. 3, and 4, screws 45 are screwed into respective third through holes 44 of the door 4, passed through the locating gaps 134 of the fixing base 13, and screwed into the screw holes 113 of the fixing posts 112 of the lock base 11 such that the lock base 11 is securely joined to the door 4; the screws 45 also contact the tail ends of the locating posts 133 to be supported by the locating posts 133; referring to FIG. 3, the outer ends of the screws 45 are in middle sections of the holes 44 instead of on the surface of the first edge of the door 4, and plugs 46 are securely fitted in outer ends of the holes 44 to prevent the screws 45 from being visible.

Thus, people inside the house also have to use the key to operate the inner locking element 1 to unlock the door 4 after the door 4 is locked by means of operating the locking element 1 or 2 with the key.

From the above description, it can be easily understood that the lock in the present invention has an advantage that none of the screws show to be easily undoable, which are used to fasten the locking elements 1, 2 to the door, and in turns, thieves can't easily damage, dismantle or remove the present lock from the door to open the door for stealing.

What is claimed is:

1. An improvement on a bi-directional lock, comprising an inner locking element securely joined to an inner side of a door;

an outer locking element securely joined to an outer side of the door; and an engaging element secured to a first edge of the door, and associated with the locking elements so that a dead bolt thereof is movable between a locking position projecting from the first edge of the door and an unlocking position retreating into the first edge by means of operating the locking elements with a key;

the outer locking element having a plurality of hollow posts formed with screw threads on inner sides; the hollow posts being inserted in respective ones of first holes extending from the outer side to the inner side of the door;

the inner locking element having a fixing base having hollow posts formed with screw threads on inner sides; the hollow posts of the fixing base being inserted in respective ones of the first holes of the door; the fixing base and the outer locking element being secured to respective sides of the door by means of screwing first screws into the threaded hollow posts of the fixing base of the inner locking element, and the threaded hollow posts of the outer locking element;

the inner locking element having a lock base disposed over the fixing base thereof; the lock base having a plurality of fixing posts projecting into respective ones of second through holes of the door; each of the fixing posts having a screw hole at a tail end thereof; the door having third through holes extending inside from the first edge thereof to communicate with the second through holes of the door; the fixing base of the inner locking element having locating posts, which project into the second through holes of the door, and each of which has a gap at a tail end thereof; the lock base of the inner locking element being secured to the door by means of screwing second screws into the third through holes of the door, and the screw holes of the fixing posts of the lock base; the second screws being passed through the gaps of the locating posts, and contacting the locating posts to be supported by the locating posts.

2. The bi-directional lock as claimed in claim 1, wherein each of the gaps of the locating posts is formed with a laid-down U-shape.

* * * * *